US012055074B1

(12) United States Patent
Claywell et al.

(10) Patent No.: US 12,055,074 B1
(45) Date of Patent: Aug. 6, 2024

(54) VEHICLE SYSTEM

(71) Applicant: GM Global Technology Operations LLC, Detroit, MI (US)

(72) Inventors: Mark R. Claywell, Birmingham, MI (US); Wesley Rieves Haney, Linden, MI (US); Julie Starr, Farmington Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 18/507,667

(22) Filed: Nov. 13, 2023

(51) Int. Cl.
*F01L 1/344* (2006.01)
*F01L 1/053* (2006.01)
*F01L 13/00* (2006.01)

(52) U.S. Cl.
CPC ..... *F01L 1/3442* (2013.01); *F01L 1/053* (2013.01); *F01L 2013/105* (2013.01); *F01L 2201/00* (2013.01); *F01L 2800/11* (2013.01); *F01L 2800/14* (2013.01); *F01L 2820/033* (2013.01)

(58) Field of Classification Search
CPC ... F01L 1/053; F01L 1/3442; F01L 2013/105; F01L 2201/00; F01L 2800/11; F01L 2800/14; F01L 2820/033
USPC ..... 123/90.15
See application file for complete search history.

(56) References Cited

U.S. PATENT DOCUMENTS 9,546,577 B2 * 1/2017 Kokubo ..... F02D 13/0219
2021/0140378 A1 * 5/2021 Yamamoto ..... F02P 5/045

* cited by examiner

*Primary Examiner* — Jorge L Leon, Jr.
(74) *Attorney, Agent, or Firm* — Honigman LLP; Matthew H. Szalach; Jonathan P. O'Brien

(57) ABSTRACT

A vehicle system includes a vehicle engine, a plurality of intake and exhaust valves coupled to the vehicle engine configured to adjust performance of the vehicle engine, and a camshaft coupled to the plurality of intake and exhaust valves and configured to control timing of the intake and exhaust valves. The vehicle system also includes a camshaft phaser configured to adjust the position of an engine's camshaft. Moreover, the vehicle system includes a vehicle processor. The vehicle processor is configured to store data including vehicle data, and apply increased oil pressure to the camshaft phaser based on vehicle data such that oil pressure is increased at a predetermined vehicle data range of camshaft phaser instability to prevent future camshaft position instability.

18 Claims, 3 Drawing Sheets

VEHICLE SYSTEM

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates generally to a vehicle system and more specifically to a vehicle system having a vehicle engine.

Vehicle engines are a main component of a vehicle. The vehicle engine is configured to convert chemical energy from fuel to mechanical energy that helps power the engine and, thus, the vehicle. Vehicle engines include various components including one or more camshafts configured to operate a plurality of valves, including intake and exhaust valves. Movement of the camshaft corresponds with opening and closing of the valves. Therefore, the camshaft position determines when the intake or exhaust valves open and close and is a key factor in the amount of power that the vehicle engine produces. During operation, a specific camshaft position can increase power at high engine speeds, but may result in less torque being produced at low engine speeds.

Additionally, the vehicle engine includes one or more camshaft phasers configured to adjust the position of the camshaft. During some vehicle engine operations, including high or medium engine speeds in combination with low torque requirements, the camshaft phasers can become unstable leading to a reduction in vehicle performance. A system is needed to address this instability.

SUMMARY

In one configuration, a vehicle system includes a vehicle engine and a plurality of intake and exhaust valves coupled to the vehicle engine and configured to adjust performance of the vehicle engine. The vehicle system also includes a camshaft coupled to the plurality of intake and exhaust valves and configured to control timing of the intake and exhaust valves. Additionally, the vehicle system includes a camshaft phaser configured to adjust a position of the camshaft. The vehicle system also includes a vehicle processor. The vehicle processor is configured to store data including vehicle data and apply increased oil pressure to the camshaft phaser based on vehicle data such that oil pressure is increased at a predetermined vehicle data range of camshaft phaser instability to prevent future camshaft position instability.

The vehicle system may also include one or more of the following optional features. For example, the vehicle data may include data related to engine load such that the oil pressure is increased with a decreasing engine load. Additionally, the boundaries of the predetermined vehicle data range may be consistently updated based on vehicle data. The vehicle processor may also be configured to compare current and predetermined desired camshaft position and apply the increased oil pressure based on vehicle data or if the current camshaft position and the desired camshaft position have a difference greater than a predetermined error amount. Additionally, a vehicle may incorporate the vehicle system.

In another configuration, a vehicle engine system includes a vehicle processor configured to store data including vehicle data and camshaft data. Additionally, the vehicle processor is configured to determine whether a camshaft phaser is within a predetermined unstable range based on one or more of vehicle data and camshaft data. Moreover, the vehicle processor is also configured to apply incremental oil pressure increases to the camshaft phaser if it is determined that the camshaft phaser is within the predetermined unstable range to prevent future instability.

The vehicle system may also include one or more of the following optional features. For example, the incremental oil pressure increase may be a single maximum oil pressure increase. Additionally, the predetermined unstable range may be continually updated based on vehicle data feedback including one or more of measured camshaft peak-to-peak camshaft position error within a time period, camshaft position bank-to-bank correlation, camshaft position peak-to-peak amplitude, camshaft position error greater than a threshold, and a filtered position value minus an instantaneous position value that is greater than a threshold. The vehicle processor may also be configured to determine a diagnostic value based on one or more of the vehicle feedback including one or more of measured camshaft peak-to-peak camshaft position error within a time period, camshaft position bank-to-bank correlation, camshaft position peak-to-peak amplitude, camshaft position error greater than a threshold, and a filtered position value minus an instantaneous position value that is greater than a threshold. Additionally, the vehicle processor may be configured to identify a camshaft phaser error condition if it is determined that the diagnostic value is greater than a predetermined value such that the vehicle processor is configured to reevaluate whether the camshaft phaser is within the predetermined unstable range after a predetermined amount of time prior to applying the incremental oil pressure increases. Moreover, the incremental oil pressure increases may be continued until the camshaft phaser no longer exceeds the predetermined unstable range. Additionally, the incremental oil pressure increases are learned and stored in the vehicle processor such that the incremental oil pressure increases may be implemented regardless of the phaser instability criteria whenever the vehicle is operating in the unstable zone based on the vehicle data. Moreover, a vehicle may incorporate the vehicle system.

In another configuration, a vehicle system includes a vehicle processor configured to store data including vehicle data and determine whether a camshaft phaser is within a predetermined unstable area based on vehicle data. Moreover, the vehicle processor is configured to command a predetermined increased oil pressure from an oil pump and override one or more feedback loops from the oil pump to sustain the increased oil pressure from the oil pump.

The vehicle system may also include one or more of the following optional features. For example, the one or more feedback loops is one or more of a proportional feedback loop, an integral feedback loop, or a differential feedback loop. Additionally, the predetermined unstable range may be continually updated based on vehicle data feedback. The vehicle processor may also be configured to store a vehicle mode and the determination of whether the camshaft phaser is within the predetermined unstable area may also be based on the vehicle mode. Additionally, the predetermined increased oil pressure from the oil pump may be a maximum increase of oil pressure. Moreover, the vehicle data may include oil temperature of oil configured to flow through the camshaft phaser and the increase in oil pressure or the maximum increase in oil pressure may be variable based on the oil temperature. Additionally, a vehicle may incorporate the vehicle system.

BRIEF DESCRIPTION OF THE DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
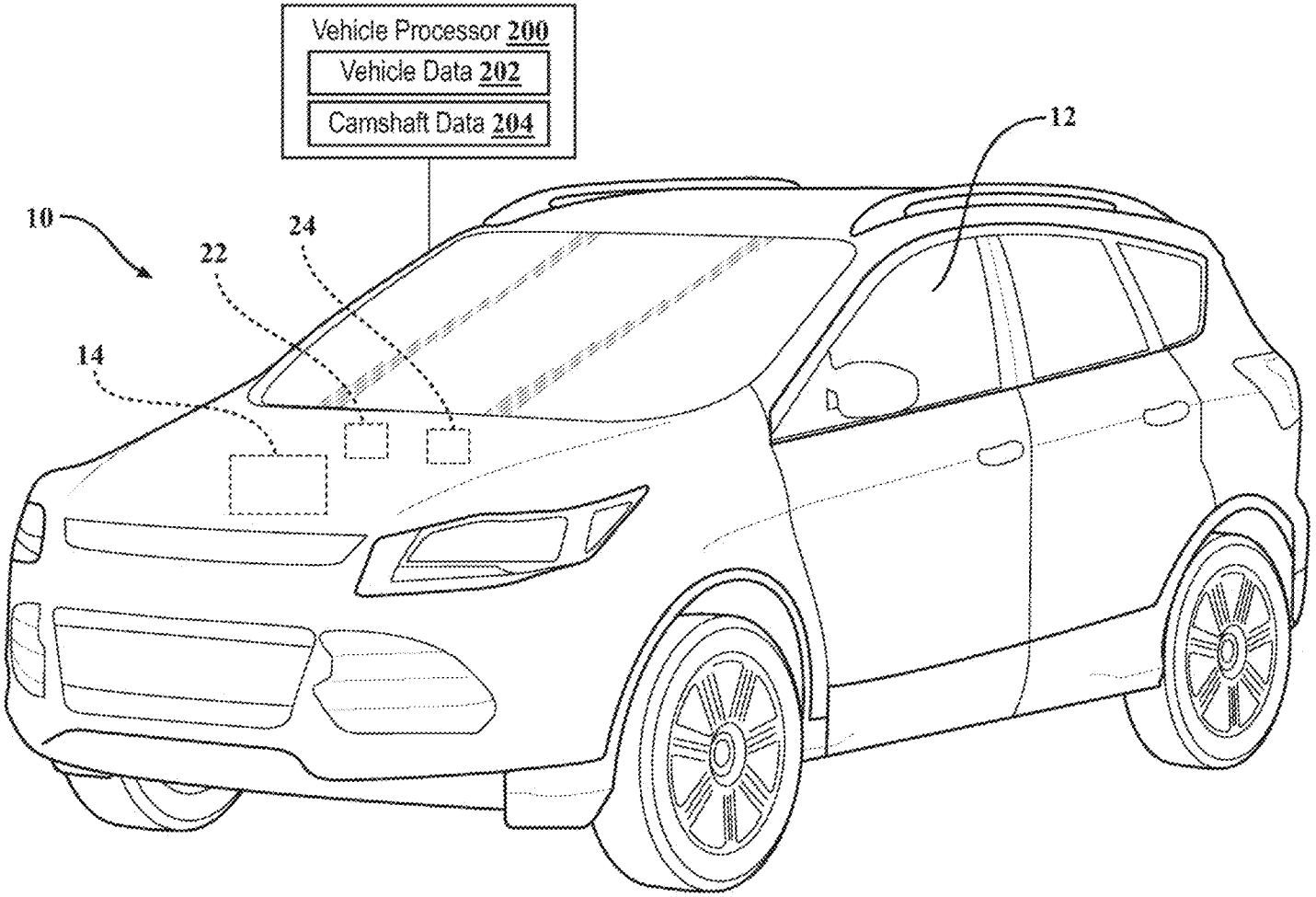
FIG. 1 is a perspective exterior view of a vehicle including the vehicle system according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms "first," "second," "third," etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In this application, including the definitions below, the term "module" may be replaced with the term "circuit." The term "module" may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term "code," as used above, may include software, firmware, and/or microcode, and may refer to programs, routines, functions, classes, and/or objects. The term "shared processor" encompasses a single processor that executes some or all code from multiple modules. The term "group processor" encompasses a processor that, in combination with additional processors, executes some or all code from one or more modules. The term "shared memory" encompasses a single memory that stores some or all code from multiple modules. The term "group memory" encompasses a memory that, in combination with additional memories, stores some or all code from one or more modules. The term "memory" may be a subset of the term "computer-readable medium." The term "computer-readable medium" does not encompass transitory electrical and electromagnetic signals propagating through a medium, and may therefore be considered tangible and non-transitory memory. Non-limiting examples of a non-transitory memory include a tangible computer readable medium including a nonvolatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

A software application (i.e., a software resource) may refer to computer software that causes a computing device to perform a task. In some examples, a software application may be referred to as an "application," an "app," or a "program." Example applications include, but are not limited to, system diagnostic applications, system management applications, system maintenance applications, word processing applications, spreadsheet applications, messaging applications, media streaming applications, social networking applications, and gaming applications.

The non-transitory memory may be physical devices used to store programs (e.g., sequences of instructions) or data (e.g., program state information) on a temporary or permanent basis for use by a computing device. The non-transitory memory may be volatile and/or non-volatile addressable semiconductor memory. Examples of non-volatile memory include, but are not limited to, flash memory and read-only memory (ROM)/programmable read-only memory (PROM)/erasable programmable read-only memory (EPROM)/electronically erasable programmable read-only memory (EEPROM) (e.g., typically used for firmware, such as boot programs). Examples of volatile memory include, but are not limited to, random access memory (RAM), dynamic random access memory (DRAM), static random access memory (SRAM), phase change memory (PCM) as well as disks or tapes.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, non-transitory computer readable medium, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Various implementations of the systems and techniques described herein can be realized in digital electronic and/or optical circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

The processes and logic flows described in this specification can be performed by one or more programmable processors, also referred to as data processing hardware, executing one or more computer programs to perform functions by operating on input data and generating output. The processes and logic flows can also be performed by special purpose logic circuitry, e.g., an FPGA (field programmable gate array) or an ASIC (application specific integrated circuit). Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, one or more aspects of the disclosure can be implemented on a computer having a display device, e.g., a CRT (cathode ray tube), LCD (liquid crystal display) monitor, or touch screen for displaying information to the user and optionally a keyboard and a pointing device, e.g., a mouse or a trackball, by which the user can provide input to the computer. Other kinds of devices can be used to provide interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Figure 2:
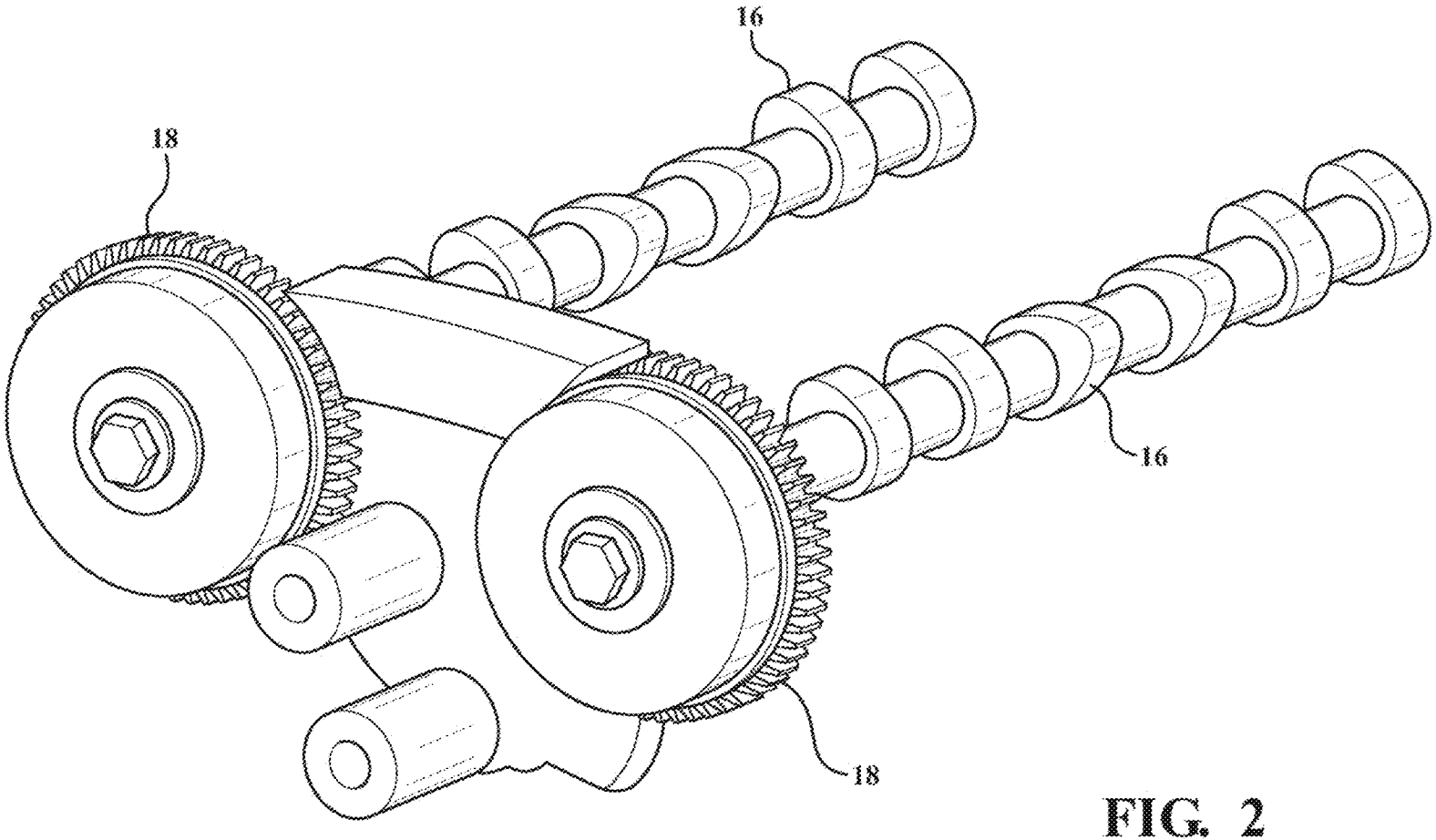
FIG. 2 is a perspective view of a camshaft of the vehicle system according to the present disclosure.
Figure 3:
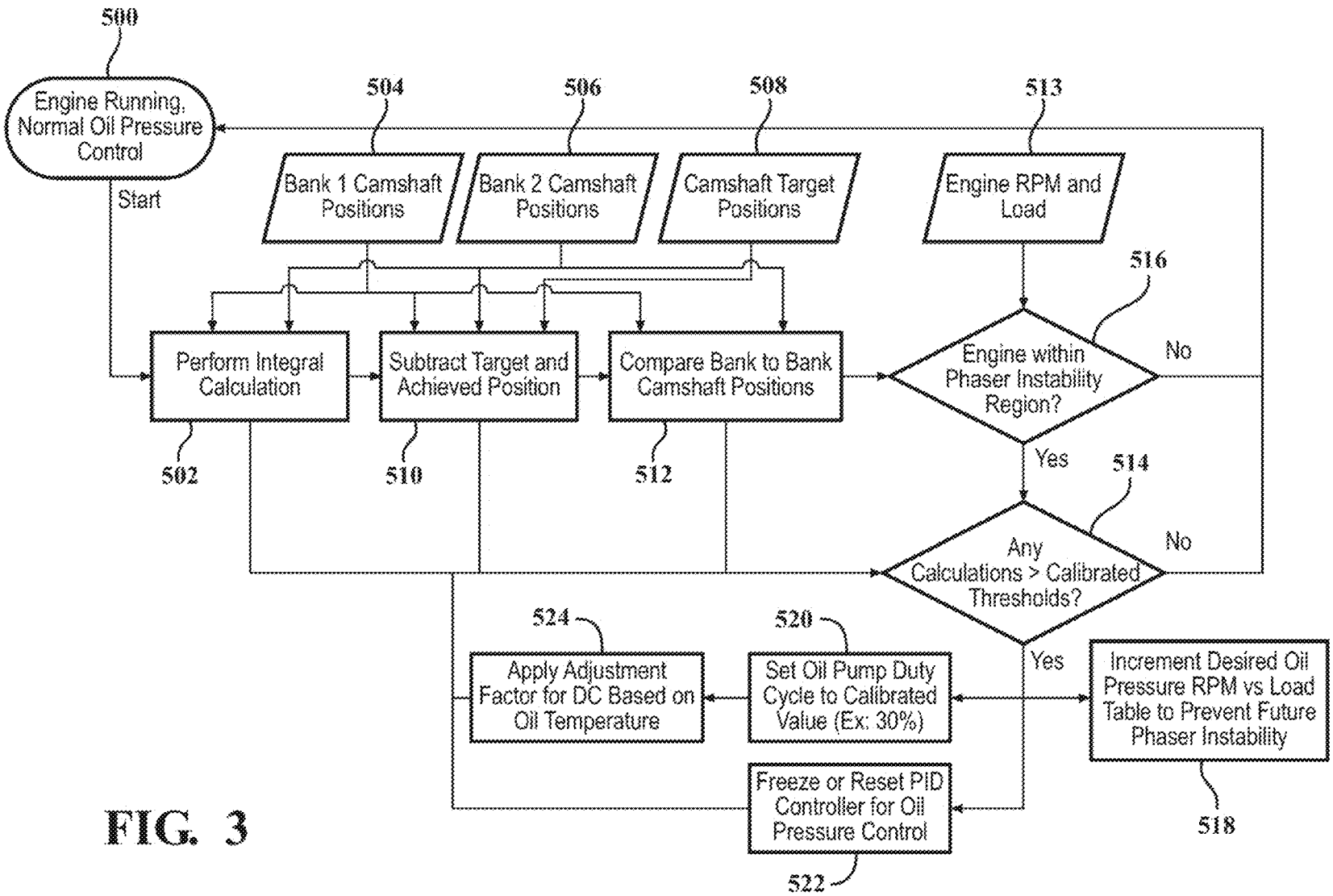
FIG. 3 is an exemplary operational flow diagram for the vehicle system according to the present disclosure.

Referring now to the example shown in FIGS. 1-3, a vehicle system is illustrated at reference number 10. In some examples, such as the example shown in FIG. 1, the vehicle system 10 is incorporated into a vehicle 12. The vehicle 12 may be a hybrid electric vehicle (HEV) incorporating both electric vehicle (EV) and internal combustion engine (ICE) components and capabilities or could incorporate only ICE components and capabilities. While the vehicle 12 could be an HEV, the vehicle 12 will be described as incorporating only ICE components and capabilities. Accordingly, the vehicle 12 will be described and shown hereinafter and in the drawings as including an engine 14.

The vehicle engine 14 may be an ICE and includes various components configured to provide various operations requiring power for the vehicle 12. For example, the vehicle engine 14 may be an eight cylinder ICE (V8) having two banks (a first bank and a second bank) of four cylinders with each of the two banks sharing a common crankshaft (not shown). The vehicle engine 14 also includes various other components including one or more camshafts 16 configured to operate a plurality of valves (not shown), including intake and exhaust valves, and a camshaft phaser 18. Additionally, the intake and exhaust valves are configured to adjust performance of the vehicle engine 14. More specifically, movement of the camshaft 16 corresponds with opening and closing of the intake and exhaust valves, which affects an oil pressure within the vehicle system 10. Therefore, a position of the camshaft 16 determines the opening and closing timing of the intake and/or exhaust valves and is a key factor in the amount of power that the vehicle engine 14 produces. For example, a specific position of the camshaft 16 can increase power at high engine speeds but may result in less torque being produced at low engine speeds. While the vehicle engine 14 may include one or more camshafts 16 and associated phasers 18, the vehicle engine 14 will be described and shown hereinafter as including two (2) camshafts 16 and associated phasers 18.

As best shown in FIGS. 1 and 2, the vehicle engine 14 includes the camshaft phasers 18 attached to the camshafts 16. The camshaft phasers 18 are configured to adjust a rotational position of the camshafts 16 upon command from a vehicle processor 200 to adjust performance of the vehicle engine 14. In the example shown, the camshaft phasers 18 are one or more hydraulic actuators configured to electromechanically adjust the position of the camshafts 16, however, various other configurations have also been contemplated including fully mechanical or fully electrical configurations.

The camshaft phasers 18 rely on engine oil pressure to operate. The oil may be sourced from an oil pump coupled to the vehicle engine 14, or from another source as desired. Additionally, the oil pump may a variable-control oil pump or other oil storing device commanded by the vehicle processor 200. Moreover, the oil pump may be controlled using typical proportional—integral—derivative (PID) control.

During some vehicle engine operations, including high or middle engine speeds in combination with low torque requirements, the camshaft phasers 18 can become unstable leading to vehicle 12 performance issues. The vehicle system 10 as described herein is configured to prevent camshaft phaser 18 instability. However, should camshaft instability occur, the vehicle system 10 is configured to detect the instability quickly and make adjustments to one or more of the camshafts 16 via the camshaft phasers 18 to correct the instability.

The vehicle system 10 also includes the vehicle processor 200 configured to store data and control movement of the camshaft phasers 18. The vehicle processor 200 may be an engine control unit (ECU) or other vehicle controller. Additionally, the vehicle processor 200 is configured to store data including vehicle data 202 and camshaft data 204. The vehicle data 202 includes one or more of oil temperature and/or pressure, vehicle speed, vehicle torque, and vehicle mode. The oil temperature and/or pressure generally pertains to the current temperature and/or pressure of the oil flowing through the camshaft phasers 18. The oil temperature and/or pressure may be determined by sensors (none shown) within the system or may be measured or obtained from another source. In some examples, the oil temperature and/or pressure may be constantly changing such that the temperature and/or pressure of the oil may be continually sensed and/or obtained during vehicle operation.

The vehicle speed generally pertains to a current speed of the vehicle 12. The vehicle speed may be obtained, sensed, measured, and/or calculated from one or more vehicle sensors 22 and/or cameras 24. Additionally or alternatively, the vehicle speed generally pertains to a speed of the vehicle engine 14. More specifically, the vehicle engine speed may be represented as "revolutions per minute" or RPM and represents the number of times the crankshaft of the vehicle engine 14 makes a full rotation every 60 seconds. Additionally, the RPM may be displayed on a vehicle dashboard in addition to being stored in the vehicle processor 200. Moreover, the vehicle speed may be constantly changing such that the vehicle speed may be continually sensed and/or obtained during vehicle operation.

The vehicle torque generally pertains to the amount of power produced by the vehicle engine 14. The vehicle torque may be measured, sensed, or obtained by various vehicle sensors 22 or other devices. The vehicle torque may pertain to the current amount of torque generated by the vehicle engine 14. Additionally, or alternatively, the vehicle torque may pertain to an amount of torque desired. Further, it is also contemplated that the vehicle torque may additionally or alternatively pertain to a difference between the current amount of torque generated and the amount of torque desired.

The vehicle mode generally pertains to the mode of the vehicle. Vehicle modes include, but are not limited to, a performance mode, a hot mode, and/or a regular driving mode. The vehicle mode may be measured, sensed, or obtained by various vehicle sensors 22 or determined by the vehicle processor 200.

The camshaft data 204 generally pertains to specific data related to the camshafts 16. For example, the camshaft data 204 may include a current position of the camshafts 16. The current position of the camshafts 16 generally pertains to the position that the camshafts 16 are in currently. The position may be measured, sensed, or otherwise obtained from vehicle sensors 22 and/or the vehicle processor 200 in the vehicle 12. Additionally or alternatively, the camshaft data 204 may also include a desired position of the camshafts 16, which may also be measured, sensed, or otherwise obtained. Moreover, the desired position of the camshafts 16 may be predetermined based on the vehicle data 202 or other information. For example, the predetermined desired camshaft position may be calculated or determined based on vehicle engine speed and vehicle engine load. Additionally or alternatively, the camshaft data 204 may also include camshaft position error, which may be calculated using the current camshaft position and the desired camshaft position. Moreover, camshaft position error may be calculated using the current camshaft position and the desired camshaft position along with a bias value. The bias value may be a predetermined value and/or may be based on the vehicle data 202. Additionally or alternatively, the camshaft position error may be calculated using positions of the camshaft phasers 18. More specifically, the camshaft position error may be calculated using a difference in position between the camshaft phasers 18 coupled to the intake valve and the camshaft phasers 18 coupled to the exhaust valve. Additionally or alternatively, the camshaft position error may be calculated using an integrated value of the position of the camshaft phasers 18 along with a filtered position of the position of the camshaft phasers 18 in order to detect rapid camshaft phaser oscillation. Additionally, the camshaft data 204 may also include data related to camshaft peak-to-peak camshaft position error within a time period, camshaft peak-to-peak amplitude, and the comparison of camshaft position between multiple banks within the vehicle engine 14.

Additionally, the vehicle processor 200 is also configured to compare the current camshaft positions and the predetermined desired camshaft positions. Moreover, if a current camshaft position is different from a desired camshaft position, the vehicle processor 200 can command increased oil pressure to one or more of the camshaft phasers 18 such that oil pressure is increased within the vehicle system 10 providing stability to the camshaft phaser 18. The increased oil pressure may be drawn from the variable-control oil pump or other oil storing device and commanded by the vehicle processor 200. Additionally, the oil pump may be controlled using typical proportional—integral—derivative (PID) control. The increased oil pressure from the oil pump prevents future camshaft position instability by increasing the oil pressure prior to instability of one or more of the camshaft phasers 18.

Additionally, the vehicle processor 200 may be configured to increase the oil pressure to the camshaft phasers 18 based on the vehicle data 202 including, but not limited to, vehicle engine speed and vehicle torque. The increase in oil pressure may be an incremental amount of increased oil pressure occurring multiple times over a period of time. However, in some examples, the increase in oil pressure may be a single maximum oil pressure increase such that the vehicle processor 200 commands the oil pump to increase the oil pressure to a maximum amount. Moreover, the increased oil pressure may be applied if the vehicle data 202 is within a predetermined range. The predetermined range may be based on any vehicle data 202 including, but not limited to, vehicle engine speed and vehicle torque. For example, a high engine speed along with a low torque requirement may trigger the increased oil pressure. By commanding the increased oil pressure based on the vehicle data 202 in the predetermined range, the vehicle processor 200 can prevent future camshaft position instability. Additionally, to continually improve the boundaries of the predetermined range, the predetermined range may be consistently updated based on updated vehicle data 202.

Referring still to the examples shown in FIGS. 1-3, the vehicle processor 200 may also be configured to determine whether the camshaft phasers 18 are operating in an unstable manner based on predetermined instability thresholds within a predetermined unstable range. Determining whether one or more of the camshaft phasers 18 is unstable (i.e., within the predetermined unstable range) allows the vehicle processor 200 to implement additional oil pressure prior to the camshaft phasers 18 reaching an instability that cannot be corrected. The determination of whether the camshaft phaser 18 is unstable (i.e., within the predetermined unstable range) may be based on the vehicle data 202. The vehicle data 202 used to determine the camshaft phaser 18 instability may include one or more of camshaft peak-to-peak camshaft position error within a time period, camshaft position correlation between banks within the engine, camshaft peak-to-peak amplitude, and camshaft position error. Additionally, the predetermined unstable range may correlate with high vehicle engine speed and low engine torque.

Additionally, the instability criteria of the camshaft phasers 18 (i.e., the boundaries of the predetermined unstable range) may be continually updated based on the vehicle data 202 including one or more of camshaft peak-to-peak camshaft position error within a time period, comparison of camshaft positions between multiple banks of the engine 14, camshaft peak-to-peak amplitude, and camshaft position error. For example, if it is determined that a camshaft 16 has a camshaft position error (e.g., the current camshaft position is different than the predetermined position) for more than a predetermined amount of time, the associated camshaft phaser 18 may be determined to be unstable. In another example, if the difference between the current camshaft position near the intake valves and the current camshaft position near the exhaust values is greater than a predetermined value, the camshaft phasers 18 may be determined to be within the predetermined unstable range. Additionally, in another example, if a filtered camshaft phaser position minus the current camshaft position is greater than a predetermined value, than the camshaft phaser 18 may be determined to be within the unstable range.

If it is determined that the camshaft phaser 18 is unstable (i.e., within the predetermined unstable range), the vehicle processor 200 may be configured to apply incremental oil pressure increases to the camshaft phaser 18 to prevent further instability. However, in some examples, the incremental oil pressure increases may be a single maximum oil pressure increase, if desired. The incremental oil pressure increases may be continued until the camshaft phaser 18 no longer meets the criteria to be considered unstable.

Additionally, the vehicle processor 200 is configured to identify or flag a camshaft phaser error condition if it is determined that the camshaft phaser 18 is within the predetermined unstable range. The flag allows the vehicle processor 200 to closely monitor the camshaft phaser 18 and to repeat the camshaft phaser error calculation after a predetermined amount of time to verify the instability. The increase in oil pressure may only be activated if the number of flags is over a predetermined threshold. However, it is also contemplated that the increase in oil pressure may be activated after a single flag, if desired.

Additionally, the vehicle processor 200 may be configured to determine a diagnostic value based on one or more of the feedback of the vehicle data 202 including one or more of measured camshaft peak-to-peak position error within a time period, correlation of camshaft position between multiple engine banks, camshaft peak-to-peak amplitude, camshaft position error greater than a threshold, and a filtered position value minus an instantaneous position value being greater than a threshold. Moreover, the vehicle processor 200 is also configured to flag the camshaft phaser error condition if it is determined that the diagnostic value is greater than a predetermined value. The flag, as described above, allows the vehicle processor 200 to closely monitor the camshaft phaser 18 and to repeat the calculation of whether the camshaft phaser 18 is within the predetermined unstable range after a predetermined amount of time prior to applying the incremental oil pressure increases. The diagnostic value may also be used by the vehicle processor 200 or other vehicle systems to diagnose vehicle engine issues or other related issues.

Additionally, the predetermined unstable range may be affected by oil temperature. More specifically, if the oil temperature is above a predetermined threshold, the increased oil pressure may not be commanded in order to prevent damage to the vehicle system 10. However, in some examples, if the oil temperature is below a certain threshold, the amount of increased oil pressure may be adjusted to account for the oil temperature. The predetermined threshold temperature may be a known value or may be calculated and/or determined based on vehicle data 202. Additionally, whether the increase in oil pressure is incremental or a maximum increase may be based on the oil temperature. For example, if a maximum increase is desired but the oil temperature is too cold to produce a maximum increase, the increase in oil pressure may be determined to be an incremental increase instead.

Additionally, the vehicle processor 200 may also be configured to sustain the increased oil pressure by overriding one or more feedback loops from the oil pump. For example, the vehicle processor 200 may be configured to override an integral feedback loop. In other examples, the vehicle processor 200 is configured to override a proportional feedback loop. In other examples, the vehicle processor 200 is configured to override a differential feedback loop. Additionally, in other examples, the vehicle processor 200 may also be configured to override more than one of the integral feedback loop, the proportional feedback loop, and the differential feedback loop. Moreover, the override of the one or more feedback loops may only be commanded by the vehicle processor 200 if the oil temperature is above a predetermined threshold temperature.

In some examples, the amount of increase in oil pressure may also be based on the vehicle mode. For example, if the vehicle 12 is in a performance mode, the amount of oil pressure increase needed may be different than in a traditional driving mode. In another example, if the vehicle 12 is in a hot mode, such that the vehicle 12 determines the weather is very hot and, thus, adjusts accordingly, the amount of oil pressure increase needed may be different than in a traditional driving mode.

Referring now to the example shown in FIG. 3, in operation, the vehicle 12 is operating at a normal oil pressure with normal controls at step 500. The vehicle processor 200 performs calculations at step 502 using vehicle data 202 including the camshaft positions for the intake camshaft 16 and exhaust camshaft 16 on the first bank of the engine at 504, the camshaft positions for the intake and exhaust camshafts 16 on the second bank at 506, and the desired camshaft position at 508. The calculations may include one or more of the calculation of the camshaft peak-to-peak position error within a time period, comparison of camshaft positions between multiple engine banks, and camshaft peak-to-peak amplitude. Other calculations shown here include subtracting the desired camshaft position and the current camshaft position at step 510 and comparing the camshaft positions at step 512. The vehicle processor 200 inputs the vehicle engine speed and the engine torque at step 513 and determines if any of the calculations are found to be over the predetermined thresholds at step 514. Additionally, the vehicle processor 200 determines if the camshaft phaser 18 is within the predetermined unstable range at step 516. If any predetermined thresholds are exceeded and/or if the camshaft phaser 18 is within the predetermined unstable range, the oil pressure may be increased incrementally to prevent future camshaft phaser instability at step 518. Additionally, the oil pump duty cycle may be set to a calibrated value at step 520. Then the adjustment value may be applied to the oil pump based on oil temperature at step 524. Additionally, the vehicle processor 200 may freeze or reset one or more of the integral feedback loop or the proportional feedback loop at step 522. The vehicle processor 200 continues steps 518, 520, 522, and 524 until the calculations are below the predetermined thresholds and/or out of the unstable range.

During some vehicle engine operations, including high or medium vehicle engine speed in combination with low torque requirements, the camshaft phasers 18 can become unstable leading to vehicle performance issues. The vehicle system 10 as described herein is configured to prevent camshaft phaser instability all together by incrementally adding oil pressure when the difference between the current camshaft location and the desired camshaft location is above the predetermined threshold. Additionally, the vehicle system 10 as described herein is configured to detect camshaft phaser instability quickly before camshaft phaser instability becomes unrecoverable by increasing the oil pressure when the camshaft phaser 18 is determined to be in the predetermined unstable range. By preventing and/or diagnosing and reversing camshaft phaser instability, oil pressure is able to stay at a lower oil pressure value during normal operations. This leads to numerous benefits including fuel economy, lower thermal impact, lower oil aeration, more oil volume retained in the oil tank for dry sump systems, and improved oil pump life.

A number of implementations have been described. Nevertheless, it will be understood that various modifications may be made without departing from the spirit and scope of the disclosure. Accordingly, other implementations are within the scope of the following claims.

The foregoing description has been provided for purposes of illustration and description. It is not intended to be exhaustive or to limit the disclosure. Individual elements or features of a particular configuration are generally not limited to that particular configuration, but where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A vehicle system comprising:

a vehicle engine including a camshaft phaser configured to adjust performance of the vehicle engine; and a vehicle processor configured to:

store data including vehicle data; and apply increased oil pressure to the camshaft phaser based on vehicle data such that oil pressure is increased at a predetermined vehicle data range indicative of camshaft phaser instability so as to prevent future camshaft position instability;

wherein the vehicle data includes data related to engine load such that the oil pressure is increased as the engine load decreases.

2. The vehicle system of claim 1, wherein boundaries of the predetermined vehicle data range are consistently updated based on the vehicle data.

3. The vehicle system of claim 1, wherein the vehicle processor is further configured to compare a current camshaft position to a target camshaft position and apply the increased oil pressure when a difference between the current camshaft position and the target camshaft position is greater than a predetermined error amount.

4. A vehicle comprising the vehicle system of claim 1.

5. A vehicle system comprising:

a vehicle engine including:

a plurality of intake and exhaust valves configured to adjust performance of the vehicle engine;

a camshaft coupled to the plurality of intake and exhaust valves so as to control a timing of the plurality of intake and exhaust valves; and a camshaft phaser configured to adjust a position of the camshaft relative to a crankshaft of the vehicle engine; and a vehicle processor configured to:

store data including vehicle data and camshaft data;

determine whether the camshaft phaser is within a predetermined unstable range based on the vehicle data and the camshaft data, the vehicle data including data related to engine load; and apply incremental oil pressure increases to the camshaft phaser when the camshaft phaser is within the predetermined unstable range so as to prevent future instability, the oil pressure being increased as the engine load decreases.

6. The vehicle system of claim 5, wherein the predetermined unstable range is continually updated based on vehicle data feedback including one or more phaser instability criteria including:

a measured camshaft position error peak-to-peak amplitude within a predetermined time period, a comparison of camshaft positions between multiple cylinder banks within the vehicle engine, a camshaft peak-to-peak amplitude, a camshaft position error being greater than a first threshold, and a difference between a filtered camshaft position value and an instantaneous camshaft position value being greater than a second threshold.

7. The vehicle system of claim 6, wherein the vehicle processor is further configured to determine a diagnostic value based on feedback from one or more of the vehicle data including:

the measured camshaft position error peak-to-peak amplitude within the predetermined time period, the comparison of camshaft positions between the multiple cylinder banks, the camshaft peak-to-peak amplitude, the camshaft position error being greater than the first threshold, and the difference between the filtered camshaft position value minus and the instantaneous camshaft position value being greater than the second threshold.

8. The vehicle system of claim 7, wherein the vehicle processor is further configured to:

identify a camshaft phaser error condition when the diagnostic value is greater than a predetermined value; and when the camshaft phaser error condition is identified, reevaluate whether the camshaft phaser is within the predetermined unstable range after a predetermined amount of time so as to verify camshaft phaser instability prior to the applying of the incremental oil pressure increases.

9. The vehicle system of claim 5, wherein the incremental oil pressure increases are continued until the camshaft phaser is no longer within the predetermined unstable range.

10. The vehicle system of claim 5, wherein the incremental oil pressure increases are learned and stored in the vehicle processor as a feed-forward control such that the applying of the incremental oil pressure increases is completed independently of whether the camshaft phaser exits the predetermined unstable range.

11. A vehicle comprising the vehicle system of claim 5.

12. A vehicle system comprising:

a vehicle processor configured to:

store data including vehicle data;

determine whether a camshaft phaser is within a predetermined unstable range based on the vehicle data including data related to engine load;

command a predetermined oil pressure increase from an oil pump, the oil pressure being increased as the engine load decreases; and override one or more feedback loops from the oil pump so as to sustain the oil pressure increase from the oil pump.

13. The vehicle system of claim 12, wherein the one or more feedback loops include one or more of a proportional feedback loop, an integral feedback loop, or a differential feedback loop.

14. The vehicle system of claim 12, wherein the predetermined unstable range is continually updated based on vehicle data feedback including one or more phaser instability criteria including:

a measured camshaft position error peak-to-peak amplitude within a predetermined time period, a comparison of camshaft positions between multiple cylinder banks within a vehicle engine, a camshaft peak-to-peak amplitude, a camshaft position error being greater than a first threshold, and a difference between a filtered camshaft position value and an instantaneous camshaft position value being greater than a second threshold.

15. The vehicle system of claim 12, wherein the vehicle processor is further configured to store a vehicle drive mode, and wherein the determining of whether the camshaft phaser is within the predetermined unstable range is further based on the vehicle drive mode.

16. The vehicle system of claim 12, wherein the predetermined oil pressure increase from the oil pump is a maximum oil pressure increase.

17. The vehicle system of claim 16, wherein the vehicle data further includes a temperature of an engine oil flowing through the camshaft and an amount of the predetermined oil pressure increase is adjusted based on the oil temperature.

18. A vehicle comprising the vehicle system of claim 12.

* * * * *